United States Patent [19]

Curry

[11] 3,982,306

[45] Sept. 28, 1976

[54] FASTENER FOR PLASTIC FILM SHEETING AND THE LIKE

[76] Inventor: Walter J. Curry, 337 Roberta Ave., Winnipeg, Manitoba, Canada

[22] Filed: July 7, 1975

[21] Appl. No.: 593,675

[52] U.S. Cl. ..... 24/243 K

[51] Int. Cl.[2] ..... A44B 21/00

[58] Field of Search ..... 24/243 K, 243 M, 243 N, 24/255 SC; 52/317, 717

[56] References Cited

UNITED STATES PATENTS

| | | | |
|---|---|---|---|
| 3,792,510 | 2/1974 | Evett | 24/243 K |
| 3,805,873 | 4/1974 | Bloomfield | 24/243 K |

*Primary Examiner*—Werner H. Schroeder
*Assistant Examiner*—Doris L. Troutman
*Attorney, Agent, or Firm*—Stanley G. Ade

[57] ABSTRACT

An extruded plastic channel receives the plastic film and a plastic locking strip is then engaged within the channel and under opposed overhanging beads on each side of the channel to clamp the film in position. One of the beads on the channel extends downwardly towards the base of the channel and an expansion bead or member extends upwardly from the base of the channel outboard of the outwardly extending bead which can flex sideways under pressure to compensate for different thicknesses of film. One embodiment includes a membrane connection between the downwardly extending bead and the expansion bead so that when the locking strip is snap engaged into the channel, the sideways displacement of the downwardly extending bead also moves the expansion bead outwardly to facilitate the engagement of the locking strip within the channel.

8 Claims, 3 Drawing Figures

FASTENER FOR PLASTIC FILM SHEETING AND THE LIKE

BACKGROUND OF THE INVENTION

This invention relates to new and useful improvements in fasteners for plastic film sheeting and the like and is an improvement over my U.S. patent application Ser. No. 406,786, filed Oct. 16, 1973.

One of the disadvantages of the previous contruction is the difficulty in holding plastic film sheeting snugly in place and to prevent them from gradually slipping out when subject wind flutter and shrinkage and expansion due to temperature change all of which cause a looseness in the plastic film resulting in a more rapid deterioration thereof.

SUMMARY OF THE INVENTION

This invention overcomes these disadvantages by providing, among other things, an expansion bead or member which can flex outwardly to permit the use of the device with various thicknesses of materials and is self adjusting to keep a snug fit at all times when the plastic film is locked in position within the channel member.

Another object of the invention is to provide a device of the character herewithin described which includes a down turned bead portion on the channel member which flexes outwardly as the locking strip is engaged.

A still further object of the invention is to provide a device of the character herewithin described in which the downturned bead engages the expansion member as it is moved outwardly thus flexing the expansion member outwardly thus allowing the locking strip to fall into place and to be held within the channel.

Still another object of the invention is to provide a device of the character herewithin described which is adapted to hold the plastic film snugly within the channel at all times regardless of the thickness of the film being used.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
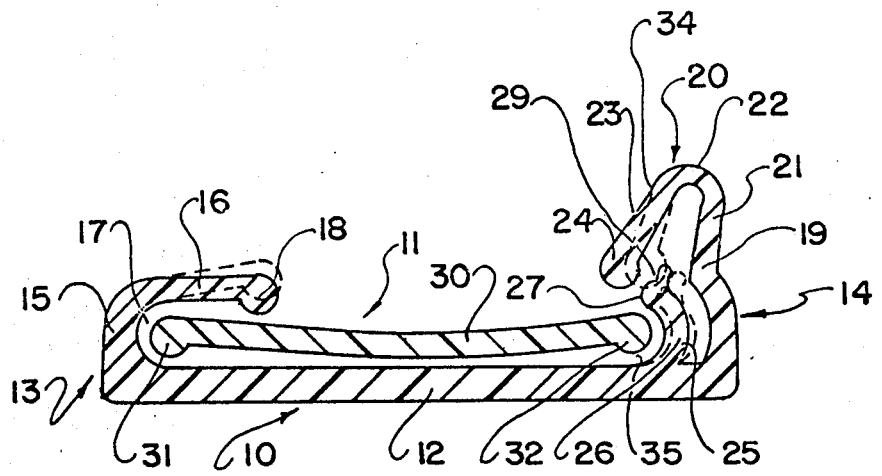
FIG. 1 is an end elevation of the preferred embodiment of the invention.
Figure 3:
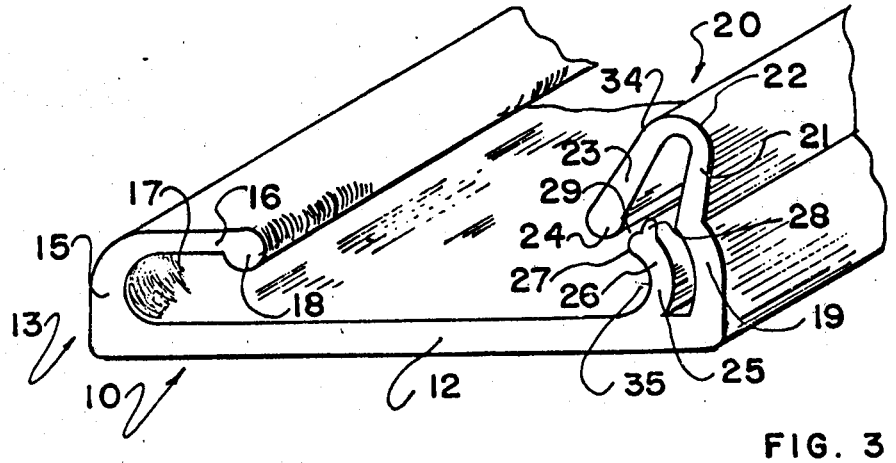
FIG. 3 is a fragmentary isometric view of the channel member illustrated in FIG. 1.

Proceeding therefore to describe the invention in detail, reference should first be made to FIGS. 1 and 3 in which 10 illustrates an elongated extruded plastic channel member and 11 indicates an elongated flexible locking strip similar to that described in the above identified patent application.

The channel member 10 includes a substantially planar base 12 and a pair of side walls collectively designated 13 and 14 respectively.

Dealing first with the side wall 13, this includes an upwardly extending portion 15 and an inwardly extending portion 16 which normally lies substantially parallel to the base 12.

The inner wall of these portions defines an elongated arcuately curved recess 17 as clearly illustrated. The inner edge of the inwardly extending portion 16 is provided with a bead 18 as clearly illustrated and this inwardly extending portion 16 can flex upwardly as indicated in phantom but the resiliency of the material normally urges it downwardly to the position shown in solid line.

The other wall 14 includes an upwardly extending portion 19 and a flexible overhanging portion collectively designated 20. This flexible overhanging portion includes the upwardly extending part 21 and an arcuately curved upper portion 22 together with a downwardly and inwardly inclined portion 23 extending from the curved portion 22 as clearly shown in FIG. 1. This downwardly and inwardly extending portion 23 terminates with a bead 24 on the lower edge thereof and can flex inwardly as indicated in phantom in FIG. 1. However the resiliency of the material normally maintains or urges this downwardly and inwardly extending portion 23, to the position shown in solid line.

Extending upwardly from the base 12 and spaced inwardly from the portion 19 of the wall 14, is an expansion member or bead 25. This expansion member curves upwardly and inwardly as illustrated by reference character 26 and is spaced from the portion 19 of the wall 14 as clearly shown. It terminates in an inwardly facing elongated bead 27 and an elongated upwardly extending portion 28 defines with the bead 27, a bead receiving pocket 29.

This expansion member 25 is relatively stiff but can move outwardly to the position shown in phantom in FIG. 1. However, the resiliency of the material normally urges and maintains the expansion member in the position shown in full line in FIG. 1.

It will be observed that the bead 24 of the portion 23, will engage within the pocket 29 when it is flexed outwardly, the purpose of which will hereinafter be described.

The locking strip 11 shown in FIG. 1 is preferably made of plastic and is concavo-convex in configuration as clearly illustrated. It includes the web portion 30 and the longitudinally extending beads 31 and 32 formed on each side edge thereof.

Figure 2:
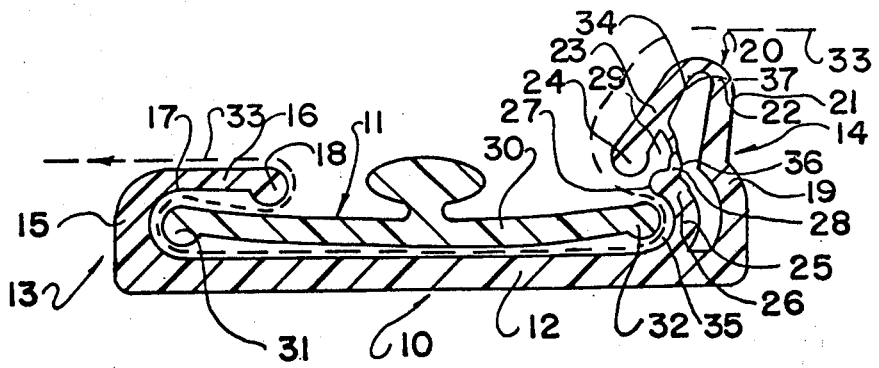
FIG. 2 is an end elevation of an alternative embodiment of the invention.

In use, a sheet of plastic film illustrated by reference character 33 in FIG. 2, is placed within the channel 10 whereupon the bead 31 of the locking strip is engaged under the horizontal portion 16 of the wall 13 and within the curved pockets 17.

The other bead 32 is then moved downwardly so that it engages the sloping surface 34 of the portion 23 of the other wall 14 due to the fact that the width of the locking strip is greater than the distance between the curved recess 17 and the bead 24.

Downward pressure upon the locking strip deflects the portion 23 outwardly as shown in phantom in FIG. 1 so that it engages within the pocket 29 of the expansion member 25. This is also deflected outwardly as shown in phantom so that the bead 32 of the locking strip falls into position within the elongated recess 35 formed by the curvature of the expansion member 25. The resiliency of the expansion member moves it towards the position shown in solid line thus clamping the film between the locking strip and within the channel and the pressure of the expansion member compensates for any difference in film thickness.

The horizontal portion 16 of the other wall 13 also moves from the position shown in phantom towards the full line position once again compensating for any difference in thickness and holding the film snugly in position against any movement caused by windage or expansion or contraction.

Of importance is the fact that the outward deflection of bead 24 engages same within pocket 29 which in turn moves the expansion member sufficiently to enable bead 32 of the locking strip to clear the bead 27 of the expansion member.

In FIG. 2, an alternative embodiment is shown which includes a relatively thin elongated web of material 36 extending between the upper side 28 of the expansion member and the inner wall 37 of the portion 23. This reinforces the cooperation between the portion 23 and the expansion member 25 and gives greater control over the clamping action of the locking strip 11 within the channel member 10.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A clamping and holding assembly for flexible plastic film sheeting and the like, comprising in combination an elongated flexible channel member, an elongated locking strip detachably engageable within said channel member for clamping the associated film sheeting therebetween, and means cooperating between said locking strip and said channel member for detachably securing said strip within said channel member, said channel member including a base and a pair of side walls extending upwardly from said base one upon each side edge thereof, one of said side walls extending upwardly and then inwardly of the corresponding side edge of said base and an elongated bead formed on the inner edge of said one side wall, the other of said side walls having a portion extending upwardly from the corresponding side edge of said base and then curving over and having a portion which extends downwardly towards said base, a longitudinally extending bead formed on the inner edge of said portion of said other side wall which extends downwardly towards said base as aforesaid, and an elongated expansion member extending upwardly from said base inwardly of said other side wall and terminating spaced from said longitudinally extending bead of said other side wall and between said last mentioned bead and the portion of the other side wall extending upwardly from said base, the width of said locking strip being greater than the width between said beads whereby said bead of said other side wall is temporarily displaced outwardly as said locking strip engaged within said channel member.

2. The assembly according to claim 1 in which said expansion member curves upwardly and inwardly from said base.

3. The assembly according to claim 1 which includes a flexible membrane connecting between said expansion member adjacent the upper edge thereof, and the inner side of said portion of said other side wall extending downwardly towards said base.

4. The assembly according to claim 2 which includes a flexible membrane connecting between said expansion member adjacent the upper edge thereof, and the inner side of said portion of said other side wall extending downwardly towards said base.

5. The assembly according to claim 1 in which said expansion member includes a bead engaging pocket formed adjacent the upper edge of said expansion member and on the inner side thereof, said bead formed on the inner edge of said other side wall engaging within said pocket when said bead of said other side wall is displaced outwardly by the engagement of said locking strip within said channel member as aforesaid, thereby temporarily moving said expansion member outwardly as said locking strip is snap engaged within said channel member.

6. The assembly according to claim 2 in which said expansion member includes a bead engaging pocket formed adjacent the upper edge of said expansion member and on the inner side thereof, said bead formed on the inner edge of said other side wall engaging within said pocket when said bead of said other side wall is displaced outwardly by the engagement of said locking strip within said channel member as aforesaid, thereby temporarily moving said expansion member outwardly as said locking strip is snap engaged within said channel member.

7. The assembly according to claim 3 in which said expansion member includes a bead engaging pocket formed adjacent the upper edge of said expansion member and on the inner side thereof, said bead formed on the inner edge of said other side wall engaging within said pocket when said bead of said other side wall is displaced outwardly by the engagement of said locking strip within said channel member as aforesaid, thereby temporarily moving said expansion member outwardly as said locking strip is snap engaged within said channel member.

8. The assembly according to claim 4 in which said expansion member includes a bead engaging pocket formed adjacent the upper edge of said expansion member and on the inner side thereof, said bead formed on the inner edge of said other side wall engaging within said pocket when said bead of said other side wall is displaced outwardly by the engagement of said locking strip within said channel member as aforesaid, thereby temporarily moving said expansion member outwardly as said locking strip is snap engaged within said channel member.

* * * * *